US005843612A

United States Patent [19]

Lin et al.

[11] Patent Number: 5,843,612

[45] Date of Patent: Dec. 1, 1998

[54] TONER AND DEVELOPER COMPOSITIONS WITH COMPATIBILIZERS

[75] Inventors: Pinyen Lin, Rochester; John G. VanDusen, Walworth, both of N.Y.

[73] Assignee: Xerox Corporation, Stamford, Conn.

[21] Appl. No.: 922,435

[22] Filed: Sep. 2, 1997

[51] Int. Cl.[6] ..... G03G 9/087; G03G 9/097

[52] U.S. Cl. ..... 430/110; 430/137

[58] Field of Search ..... 430/137, 109, 430/110

[56] References Cited

U.S. PATENT DOCUMENTS

| | | | |
|---|---|---|---|
| 4,367,275 | 1/1983 | Aoki et al. | 430/99 |
| 4,557,991 | 12/1985 | Takagiwa et al. | 430/109 |
| 4,795,689 | 1/1989 | Matsubara et al. | 430/99 |
| 4,997,739 | 3/1991 | Tomono et al. | 430/110 |
| 5,229,242 | 7/1993 | Mahabadi et al. | 430/106.6 |
| 5,364,724 | 11/1994 | Mahabadi et al. | 430/110 |
| 5,486,445 | 1/1996 | Van Dusen et al. | 430/110 |
| 5,506,083 | 4/1996 | Nash et al. | 430/109 |

FOREIGN PATENT DOCUMENTS

| | | |
|---|---|---|
| 1442835 | 7/1976 | United Kingdom . |

*Primary Examiner*—John Goodrow
*Attorney, Agent, or Firm*—E. O. Palazzo

[57] ABSTRACT

A toner composition comprised of resin, colorant, wax, and a compatibilizer of the formula $$A_{(a)}—B_{(b)}—C_{(c)}—D_{(d)}—$$

wherein A is ethylene, B is propylene, C is butene, and D is pentene, and wherein the mol fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1.

34 Claims, No Drawings

TONER AND DEVELOPER COMPOSITIONS WITH COMPATIBILIZERS

BACKGROUND OF THE INVENTION

This invention is generally directed to toner and developer compositions, and more specifically, the present invention is directed to toner compositions, including magnetic, single component, two component and colored toner compositions wherein a low toughness component (compression toughness of from about 50 lb-in/in$^3$ to about 400 lb-in/in$^3$), such as low molecular weight polymers (about 2,000<$M_n$<85,000, preferably about 3,000<$M_n$<25,000), like diblock polymers prepared from polyaddition, or polycondensation reactions are selected, for wax component dispersion enhancement, and wherein excellent jetting characteristics are enabled. Certain low toughness diblock copolymers, enable more rapid toner jetting rates, provide toners with superior wax dispersion, and furthermore improve the minimum fusing temperatures of wax containing toners. In embodiments of the present invention, the toner compositions can contain at least two polymer resins, and in embodiments from about 2 to about 10 polymers comprised, for example, of a first resin, a second crosslinked resin, a wax component, and a low toughness polymer compatibilizer component. In embodiments of the present invention, the toner compositions are comprised of resin particles, especially crosslinked extruded polyester resin particles, pigment particles, a wax component, such as polypropylene wax, and the low toughness polymer compatibilizer. There is also provided in accordance with the present invention positively or negatively charged toner compositions comprised of resin particles, pigment particles, a wax component, such as polypropylene wax, and certain diblock low toughness copolymer compatibilizers, and charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and the compatibilizer. The toner and developer compositions of the present invention are useful in a number of known electrostatographic imaging and printing systems, especially those systems wherein a wax is present in the toner. The developer compositions of the present invention, in embodiments, possess a wide fusing latitude, for example, about 100°C., which is the temperature range between the minimum fixing temperature of, for example, from about 100° C. to about 170° C. (Centigrade) of importance for fixing toner particles on paper, and the hot offset temperature, for example, from about 180° C. to about 250° C., which is the temperature where molten toner adheres to the fuser roll. The developer compositions of the present invention also provide toner images with low surface energy and a low frictional coefficient, which properties enable the effective release of paper from the fuser roll and provide for a reduction in image smudging. Further, the developer compositions of the present invention possess stable electrical properties for extended time periods, and with these compositions, for example, there is no substantial change in the triboelectrical charging values. Also, with the toner compositions of the present invention, the wax, which enhances toner release from the fuser roll and increases fusing latitude, is retained therein and the loss of wax from the toner is eliminated or minimized; and moreover, the toner compositions of the present invention with stabilized wax domains are more easily processed by extrusion, are easily and superiorly jetted which allows more rapid toner production and lower toner manufacturing costs. The control of wax concentration also enables the economy of direct recycling of toner fines obtained after particle size classification which would ordinarily be discarded as waste material. The dispersion stabilization of wax by diblock compatibilizers also decreases the minimum fusing and release temperature, thereby improving toner fusing latitude.

PRIOR ART

The following United States Patents are mentioned: U.S. Pat. No. 4,795,689 which discloses an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; U.S. Pat. No. 4,557,991 which discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest U.S. Pat. No. 3,965,021.

Developer and toner compositions with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$: from about 200 to about 6,000) to improve hot offset. In addition, a number of patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045, three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45.

However, there are various problems observed with the inclusion of polyolefin or other waxes in toners. For example, when a polypropylene wax is included in toner to enhance the release of toner from a hot fuser roll, or to improve the lubrication of fixed toner image it has been observed that the wax does not disperse well in the toner resin. As a result, free wax particles are released during the pulverizing/jetting, or micronization) step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

The aforementioned problems, and others can be eliminated, or minimized with the toner compositions and processes of the present invention in embodiments thereof. The release of wax particles is, for example, a result of poor wax dispersion during the toner mechanical blending step. The toner additives should be dispersed well in the primary toner resin for them to impart their specific functions to the toner and thus the developer. For some of the additives, such as waxes like polypropylene, VISCOL 550P™ that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanical blending the toner formulation in certain types of mixers, such as the known Banbury mixer, where the temperature of melt can be maintained at a low level and polymer viscosities are similar. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time. The use of commercially available dispersants like Kraton G-1726 or D-1118 contain triblock copolymers and high molecular weight components which do not substantially assist the thermodynamic stability and do not act as rubbery regions in the toner bulk. The elastic regions tend to create ductile fracture points and thereby reduce the jetting rate, and therefore contribute to increased cost of powder processing.

The toners of the present invention are effectively jettable it is believed because the specific low toughness copolymers added as wax compatibilizers disperse wax into domains less than for, example, 2 microns without toughening the toner composite of wax, wax dispersant, colorant, charge control agent and colorant. Moreover, the specific copolymers of the present invention are friable powders which enable better mixing of the toner components by extrusion processes.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by free wax particles; avoiding the pulverizing rate reduction resulting from the poor wax dispersion; maintaining the intended concentration of wax in the toner to provide enhanced release of toner images from the fuser roll and the avoidance of the undesirable scratch marks caused by the stripper fingers required for paper management; a wide process latitude can be provided during the mechanical blending operation of the toner manufacturing process; and the effective mechanical blending of toner is able to be accomplished in a number of devices, including an extruder.

Illustrated in U.S. Pat. No. 5,229,242, the disclosure of which is totally incorporated herein by reference, are toner compositions comprised of resin particles, pigment particles inclusive of magnetites, waxes, and for example certain compatibilizers. More specifically, this patent discloses toner compositions comprised of first resin particles, second crosslinked resin particles, pigment particles, low molecular weight waxes, such as polyethylene, and polypropylene, such as those available from Sanyo Chemicals of Japan as VISCOL 550P™ and VISCOL 660P™ and the like, and as a compatibilizer a block or graft copolymer. Examples of compatibilizers illustrated in this patent include block or graft copolymers of the structure A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726X®, a block copolymer of styrene-ethylene/butylene-styrene, KRATON G1652®, a block copolymer of styrene-ethylene/butylene-styrene, STEREON 730A®, a block copolymer of styrene and butadiene, and the like are suitable for improving the wax dispersion in styrenic resins. With KRATON G1701X® the A segment could be the styrene block and the B segment could be an ethylene/propylene block. In embodiments of this patent, there are provided toners wherein the compatibilizer is of the formula A-b-B, A-b-B or A-g-B wherein A-b-B is a block copolymer of 2 segments, A and B, A-b-B-b-A is a block copolymer of 3 segments, A, B and A, and A-g-B is a graft copolymer of segments A and B, wherein the polymeric segment A is identical or compatible to one of the components present in the toner composition, that is, the toner resin, whereas the polymeric segment B is identical or compatible with the other polymer component in the toner composition, that is, for example, the wax. Thus, in embodiments of the U.S. Pat. No. 5,229,242, the aforementioned compatibilizer can be comprised of rigid units, such as styrene, with the polymeric segment B being comprised of flexible, rubber-like units such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments.

Although the toners of U.S. Pat. No. 5,229,242 serve its intended purposes, improved wax compatibilizer compositions have been developed after extensive research and many failures. Toners with the compatibilizer of the present invention enable improved extruder mixing and processing, superior toner jetting rate, improved wax dispersions, and improved fusing properties at reduced cost. The wax compatibilizers of U.S. Pat. No. 5,229,242 are considered, it is believed, thermoplastic elastomers, which indicates a material that at room temperature (25° C.) can be stretched repeatedly at least twice its original length and upon immediate release of the stress will return with force to its original approximate length. Although the elastomeric materials in the U.S. Pat. No. 5,229,242 Examples do compatibilize wax, these high-molecular weight materials may also impart toughness and poor processing characteristics, such as poor toner jettability to the toner composite. Moreover, these commercially available elastomeric materials are often mixtures of diblock and triblock copolymers which can possess counter-productive properties in toner applications.

Further, the commercially available resins of U.S. Pat. No. 5,229,242, when present in the toner between 2 and 5 weight percent, can adversely affect toner fusing and toner jetting rates. The glass transition temperatures of the diblocks of the present invention are less than 60° C., whereas those of the U.S. Pat. No. 5,229,242 are believed to be near 80° C.; the number of blocks for the polymers of the present invention are 2, whereas those of U.S. Pat. No. 5,229,242 are typically 3, or mixtures of di- and triblock copolymers; the composition of diblock copolymers are, for example, less than 40 weight percent and are preferably between 20 and 35 weight percent of butadiene or isoprene wherein the diene components are either totally or partly hydrogenated, whereas those of U.S. Pat. No. 5,229,242 are usually more than 50 weight percent butadiene which are then completely hydrogenated.

Illustrated in U.S. Pat. No. 5,486,445, the disclosure of which is totally incorporated herein by reference, is, for example, a toner composition comprised of resin particles, pigment particles, wax component particles, and a compatibilizer comprised of a diblock polymer of hydrogenated polystyrene/polyisoprene or polystyrene/polybutadiene, with isoprene/ethylene/isopentene/vinylbutene/vinyl-2-methylbutene groups or isoprene/ethylene/butene/and vinylbutene groups, and wherein the wax and diblock form domains of an average particle diameter of from about 0.1 to about 2 microns. However, the aforementioned diblock and triblock copolymers usually possess higher melt viscosity as compared to the toner resins and wax component at melt mixing temperatures. The mismatched viscosity requires higher mixing energy and higher mixing intensity to achieve the uniformity of the wax and pigment distribution. Furthermore, the residual double bonds in the polyisoprene or polybutadiene portion are not thermally stable and can be reactive to other components in the toner at elevated temperatures. This would increase the melt rheology of the toner and change the fusing characteristics. With respect to the low toughness polymers of this invention, they possess a lower melt viscosity, higher polymer chain mobility and a superior match of the viscosity with the polymer resins in the toner. These advantages significantly reduce the required melt mixing energy and achieve improved wax and pigment dispersion. Moreover, with improved melt mixing, the amount of compatibilizers selected can be reduced to achieve the same level of wax dispersion, the jetting speed of the toner is increased, and minimum toner fusing temperature is decreased. The invention low toughness polymers are thermally stable primarily because of the absence of residual double bonds.

SUMMARY OF THE INVENTION

It is an object of the present invention to provide toner and developer compositions which possess many of the advantages indicated herein.

Another object of the present invention resides in the provision of toner and developer compositions with stable triboelectrical characteristics for extended time periods.

In another object of the present invention there are provided toner and developer compositions with excellent jetting rates and which toners enable improved dispersion of resin and wax components achievable in a number of devices, including an extruder.

Another object of the present invention relates to the provision of toner and developer compositions with a low toughness compatibilizer, and wherein for the resulting toners there is avoided, or there is minimized, the undesirable generation of particles comprised entirely of a secondary polymer component during toner preparation.

In a further object of the present invention the toner mechanical blending operation can be accomplished at a melt temperature as high as 50° C. above the melting point of the wax component, thus enabling the use of a large number of apparatuses in addition to a low melt temperature mixing process using equipment, such as a Banbury mixer, and wherein the toners are easily jettable.

In yet another object of the present invention the secondary polymeric phases in the toner will remain stable and substantial phase separation, especially over extended time periods of, for example, up to three months in embodiments, will not take place.

Another object of the present invention provides that diblock copolymers of specific compositions will enable reductions in the minimum fusing temperature of toners, including toner resins consisting of polyesters with polyolefin waxes.

Additionally, in yet another object of the present invention there are provided toner and developer compositions with certain waxes therein or thereon that enable images of excellent quality inclusive of acceptable resolutions, and that possess other advantages as illustrated herein such as low surface energy and excellent jetting rates.

Yet another object of the present invention resides in the provision of processes for the preparation of toner compositions wherein the undesirable escape of the wax contained therein is avoided or minimized.

These and other objects of the present invention can be accomplished in embodiments by providing toner and developer compositions. More specifically, the present invention is directed to toner compositions comprised of resin particles, colorants, such as pigment particles inclusive of magnetites, waxes, and as compatibilizer a low toughness polymer as illustrated herein. In embodiments of the present invention, there are provided toner compositions comprised of first resin particles, second crosslinked resin particles, colorant especially pigment particles, low molecular weight waxes, such as polyethylene, and polypropylene, such as those available from Sanyo Chemicals of Japan as VISCOL 550P™ and VISCOL 660P™, Mitsui "Hi-wax" NP055 and NP105, or wax blends such as MicroPowders, Micropro-440 and 440w, and the like, and as a compatibilizer, certain low toughness copolymers. Furthermore, there are provided in accordance with the present invention positively charged toner compositions comprised of resin particles, pigment particles, low molecular weight waxes, a low toughness copolymer compatibilizer, and a charge enhancing additive. Another embodiment of the present invention is directed to developer compositions comprised of the aforementioned toners; and carrier particles.

In addition, in accordance with embodiments of the present invention, there are provided developer compositions comprised of toner compositions containing first resin particles like a styrene butadiene resin, optional second crosslinked resins of, for example, a styrene methacrylate crosslinked with known components such as divinylbenzene, pigment particles, such as MAPICO BLACK®, magnetites, carbon blacks or mixtures thereof, low molecular weight waxes, such as polyethylene, and polypropylene, such as those available from Sanyo Chemicals of Japan as VISCOL 550P™ and VISCOL 660P™, or Mitsui "Hi-wax" NP055 and NP105, or wax blends, for example the toner can have a wax content up to about 15 percent by weight, and more specifically, from about 0.05 to about 6 weight percent, or from about 0.05 to about 6 weight percent, such as MicroPowders, Micropro-440 and 440w, a compatibilizer comprised of a low toughness diblock copolymer, and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including copolymers of vinyl chloride and trifluorochloroethylene with conductive substances dispersed in the polymeric coating inclusive of, for example, carbon black.

Embodiments of the present invention include a toner composition comprised of resin, colorant, wax, and a compatibilizer of the formula $$A_{(a)}—B_{(b)}—C_{(c)}—D_{(d)}—$$

wherein A is ethylene, B is propylene, C is butene, and D is pentene, and wherein the mol fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1; a toner wherein the colorant is a pigment; a toner wherein each of a, b, c, and d are from about 0.1 to about 0.8; a toner wherein the weight average molecular weight, $M_w$, of the compatibilizer is from about 1,000 to about 50,000; a toner wherein the weight average molecular weight, $M_w$, of said compatibilizer is from about 1,500 to about 20,000; a toner wherein the compatibilizer further contains E, F, and G, and which compatibilizer is of the formula $$A_{(a)}—B_{(b)}—C_{(c)}—D_{(d)}—E_{(e)}—F_{(f)}—G_{(g)}$$

and wherein E is a reactive functional group, F is a reactive functional group and G is styrene, and each e, f, and g are mol fractions of from about 0.05 to about 0.95, and wherein the sum of a, b, c, d, e, f, and g is about 1 mol fraction; a toner wherein E is a reactive functional group of an acid, an anhydride, a hydroxyl, a glycidyl, or an amine; and F, which is reactive with E at elevated temperatures, is an anhydride, a hydroxyl, an acid, a glycidyl, or an amine group; a toner wherein the reaction of E and F is an acid-glycidyl reaction, an amine-glycidyl reaction, an anhydride-glycidyl reaction, an anhydride-amine reaction, a hydroxyl-acid reaction, or a hydroxyl-glycidyl reaction; a toner wherein the $M_w$ of said E, F, and G segments is from about 1,000 to about 50,000, or from about 1,500 to about 20,000; a toner wherein said E, and F segments are present in the polymer in an amount of from about 0.05 to 10 per polymer chain; a toner wherein the compatibilizer is an elastomeric thermoplastic styrene copolymer; a toner further containing second crosslinked resin particles; a toner composition wherein the compatibilizer possesses a compression toughness of from, for example, about 200 to about 400 lb-in/in$^3$, or in embodiments less than about 400 lb-in/in$^3$; a toner composition wherein the wax and the compatibilizer together form domains of an average particle diameter of from about 0.1 to about 2 microns; a toner composition wherein the compatibilizer is present in an amount of from about 0.5 to about 10 weight percent, or wherein the compatibilizer is present in an amount of from about 1 to about 3 percent; a toner wherein the resin particles are selected from the group consisting of polyesters, styrene butadiene copolymers, styrene diene copolymers, styrene polyolefin copolymers, styrene acrylate copolymers, and styrene methacrylate copolymers; a toner wherein the polyester resin selected results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol; a toner wherein the first resin particles are present in an amount of from about 40 to about 90 weight percent, and the second resin particles are present in an amount of from about 60 to about 10 weight percent, or other suitable amounts; a toner wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent; a toner composition wherein the colorant is the pigment carbon black, magnetite, magenta, cyan, yellow, or mixtures thereof; a toner composition wherein the wax has a weight average molecular weight of from about 1,000 to about 10,000, wherein the wax is a polyolefin, or mixture of polyolefins, and wherein said wax is present in an amount of from about 1 to about 10 weight percent, and which toner further contains a charge enhancing additive selected from the group consisting of distearyl dimethyl ammonium methyl sulfate, a cetyl pyridinium halide, and stearyl phenethyl dimethyl ammonium tosylate, and wherein the polyolefin is polyethylene or polypropylene; a developer composition comprised the toners illustrated herein and carrier particles; a method for obtaining images which comprises generating an electrostatic latent image on a photoconductive imaging member, subsequently affecting development of this image with the toner compositions illustrated herein, thereafter transferring the image to a permanent substrate, and optionally, but preferably permanently affixing the image thereto; and a process for minimizing the amount of wax that escapes from a toner which comprises melt mixing toner resin, colorant, a wax component, and the low toughness compatibilizer illustrated herein.

Illustrative examples of suitable toner resins selected for the toner and developer compositions of the present invention, and present in various effective amounts, such as, for example, from about 65 percent by weight to about 95 percent by weight, include styrene acrylates, styrene methacrylates, styrene butadienes, styrene isoprenes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process, reference U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin like styrene butadiene, and from about 50 to about 10, and preferably about 30 weight percent of the second resin like the resin crosslinked with, for example, divinylbenzene. Preferred toner resin includes the extruded polyesters of U.S. Pat. Nos. 5,376,494 and 5,227,460, the disclosures of which are totally incorporated herein by reference.

Numerous well known suitable colorants, especially pigments, can be selected as the colorant for the toner particles including, for example, carbon black, like REGAL 330®, BLACK PEARLS®, VULCAN®, and the like, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the colorant particles are present in amounts of from about 1 percent by weight to about 20 percent by weight, and preferably from about 4 to about 10 weight percent, based on the total weight of the toner composition, however, lesser or greater amounts of colorant particles may be selected in embodiments.

When the pigment particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention there are provided colored toner compositions containing dyes, or pigments, known magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

Colorant includes pigments, dyes, mixtures thereof, mixtures of pigments, mixtures of dyes, and the like to primarily impart color to the toner.

Examples of low molecular weight, for example from about 1,000 to about 20,000, and preferably from about 1,000 to about 7,000, waxes include those as illustrated in British Patent Publication 1,442,835, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax which can remain with the toner will build up on the internal parts of the xerographic cleaning device causing a machine failure.

The low toughness compatibilizers are represented, for example, by the formula:

$$A_{(a)}—B_{(b)}—C_{(c)}—D_{(d)}—E_{(e)}—F_{(f)}—G_{(g)}$$

derived in any order, for example random, from monomers A to D where A is ethylene; B is propylene; C is butene; D is pentene; E is a reactive functional group, such as acidic, anhydride, hydroxyl, glycidyl, amine groups; and F is a reactive functional group that is reactive to E at elevated temperatures, such as anhydride, hydroxyl, acidic, glycidyl, amine groups, and G is styrene. The aforementioned monomers may be present in the polymer in the following mole fraction: (a) 0.05 to 0.95; (b) 0.05 to 0.95; (c) 0.05 to 0.95; (d) 0.05 to 0.95; (e) 0.05 to 0.95; (f) 0.05 to 0.95; and (g) 0.05 to 0.95, and wherein the total of all components is a mole fraction of 1.0. Preferably (a) to (g) are present in the following mole fraction: (a) 0.1 to 0.9; (b) 0.1 to 0.9; (c) 0.1 to 0.8; (d) 0.1 to 0.7; (e) 0.1 to 0.1; (f) 0.1 to 0.1; and (g) 0.1 to 0.8. The molecular weights of G segments are typically between about 1,000 and about 50,000 with preferred $M_w$ between about 1,500 and about 20,000. The molecular weight $M_w$ of A-B-C-D segments are from about 1,000 to about 40,000, with preferred $M_w$ values of from about 1,500 to about 20,000. The number of the E to F segments may be present in the polymer from 0 to 10 per polymer chain, and preferably from 0 to 5 per polymer chain. The $M_w$ of the entire polymer with A to G is from about 2,000 to about 90,000 and preferably from about 3,000 to about 50,000.

Examples of the compatibilizers include MODIPER resins, a product of reactive extrusion of polypropylene and polystyrene available from Nippon Oil Company of Japan, HI-WAX copolymers, styrene-modified polyethylene available from Mitsui Petrochemical Industries, Ltd. of Japan, and SEPTON® resin, styrene-ethylene/propylene copolymers available from Kuraray Company, Ltd. of Japan. Functional polystyrenes, such as polystyrene end-capped with one acidic group, can be obtained from Polymer Chemistry Innovations, Inc., of PA. Functional polyolefins, such as glycidyl methacrylate modified ethylene copolymers, OREVAC® 9312Y, can be obtained from Elf Atochem North America, Inc., of Philadelphia, Pa. The low toughness compatibilizers can then be obtained by a reactive process of the aforementioned functional polystyrenes with the aforementioned functional polyolefins with 20 to 90 weight percent of functional polystyrene, preferably 30 to 80 by weight percentage.

Illustrative examples of optional charge enhancing additives present in various effective amounts, such as for example from about 0.1 to about 20, and preferably from 1 to about 5 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; negative charge control agents, such as di-t-butylaluminum salicylate, Alohas or BONTRON E88® (available from Orient), E-88® (available from Hodogaya), tetraphenyl phosphonium tetrafluoroborate, and other known similar charge enhancing additives; and the like.

With further respect to the toner and developer compositions of the present invention, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. By contrast, when the polymeric alcohols are present as external additives, the toner composition is initially formulated and comprised of, for example, resin particles and pigment particles; and subsequently there are added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, and preferably from about 75 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including mechanical blending and melt blending the toner resin particles, pigment particles or colorants, compatibilizer, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The inclusion of compatibilizer can improve the thermodynamic compatibility between the primary and the secondary polymer phases. As a result, the secondary polymer can be well dispersed into smaller domain size with improved adhesion to the primary resin. The smaller domain size of typically less than 2 microns and the better adhesion will then prevent the secondary polymer from separating into individual particles during the pulverization operation. Wax domain sizes preferred for optimum extrusion, jetting, and fusing and release function are from 0.1 micron to 2.0 microns in diameter. Domain sizes experienced without the use of a compatibilizer are typically 0.5 to 10 microns and generally have a broad size distribution. Furthermore, the compatibilizing action can be effected even at high melt temperatures, for example 50° C. above the melting point of the wax component, when mechanical blending is difficult because of vast differences in polymer and wax viscosities. This advantage increases the process latitude of the mechanical blending operation. The advantage of including a compatibilizer may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of compatibilizer. Jetting rates, especially for styrene-acrylate and polyester binder resins, are reduced by 50 percent to 80 percent when commercial triblock, or certain graft copolymers are used as compatibilizers. With diblocks described herein, the toner jetting rates can be maintained at 90 percent to 110 percent of that for the binder resin alone. Thus, there is a significant cost advantage realized from the processing time required for grinding and jetting operations in toner manufacture. The improvement in toner jetting rate with the compatibilizer copolymers of the instant invention can, for example, be between about 2 to about 3 times more rapid than with the toners of U.S. Pat. No. 5,229,242 or U.S. Pat. No. 5,486,445. This jetting rate advantage together with fewer toner fines results in more than a two-fold reduction in the final cost of the toner.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, hydroxygallium phthalocyanines, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following Examples are provided, wherein parts and percentages are by weight unless otherwise indicated.

EXAMPLE I

There was prepared a toner composition comprised of 87 percent by weight of a branched bisphenol A fumarate, polyester resin, where the estimated level of branched chains is between 5 and 40 percent, 4 percent by weight of the polypropylene wax VISCOL660P™, available from Sanyo Chemicals of Japan, 5 percent by weight of REGAL 330® carbon black from Cabot Inc., and 4 percent by weight of HI-WAX 1140H styrene-modified polyethylene as the compatibilizer obtained from Mitsui Petrochemical Industries, Ltd. of Japan. The Hi-Wax was found to contain 40 mole percent of styrene units, or segments with 60 percent ethylene units, and was reported to have a molecular weight of 2,100 measured by high-temperature GPC.

The compatibilizer compression toughness was measured at room temperature, about 25° C. throughout, using an Instron instrument Model 8511 (ASTM D695). The crosshead speed was 1.0 inch/minute. The test specimens were prepared under vacuum by compression molding of 100 percent pure compatibilizer at 100° C., 5 psi for 5 minutes, and were gradually cooled down to room temperature at approximately 4° C./minute. The size of the test specimens was 0.25 inch in diameter and approximately 1 inch in length. Both edges were polished with sand paper #2000 to #3000 to ensure accurate contact with the load in the compression test. The stress-strain curves were recorded in the test and the compression toughness was calculated as the integration of the area of the stress-strain curve divided by the volume of the test specimen. At least three specimens were tested for the same material to reduce the test variation. The toughness of HI-WAX 1140H was calculated as 85 lb-in/in$^3$.

The toner product was extruded using a Werner & Pfleiderer ZSK-28 twin screw extruder at barrel set temperatures ranging from 90° to 120° C. at a throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified, and toner particles with volume average diameter of about 4 to 9 microns were measured by a Coulter Counter. Jetting rates were calculated from collection yields, and found to be 24 pounds/hour.

The percent by weight of the free wax particles was determined to be less than the detection limit of 0.1 percent by weight for these invention toners prepared, using a centrifugal density separation technique. The percent of total wax was estimated by differential scanning calorimetry and found to equal the 4 percent preprocess concentration. Wax domain size was estimated, from TEM photo analysis, to be on average 2.2 microns in diameter with a standard deviation of 0.8 micron. Wax diameters from similar comparative toners without the compatibilizer have a mean value of 6.4 microns with a standard deviation of 2.4 microns.

Subsequently, there was prepared a developer composition by admixing the aforementioned formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent thereover, of a polyvinylidine fluoride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. The copy quality was judged excellent with complete, uniform solid area and lines, and no measured background throughout the aforementioned imaging test. Fusing conditions for the imaging device were varied so as to determine the minimum fix temperature behavior from the developed image. The paper was released easily after the toner image was fused and no scratching was caused by stripper fingers present in the imaging device on developed solid areas as determined by visual examination. The Hot Offset Temperature evaluated as the temperature that the toner image starts to offset onto the fuser roll. Fusing evaluation by a standard image crease test was performed, and the minimum fix temperature of the toner was found to be F=−35° C. compared to an F=−19° C. to −20° C. for the same toner without this compatibilizer (A more negative value of "F" representing a lower fusing temperature). The prior art Kraton containing wax toner has an F=−25° C. to 28° C.

EXAMPLE II

A toner was prepared by repeating the toner melt mixing procedure of Example I with the exception that MODIPER® 3100, a product of reactive extrusion of polypropylene and polystyrene available from Nippon Oil Company of Japan, was selected as the compatibilizer at 4 percent by weight of premix concentration. This material was found to contain 30 weight percent styrene units with 70 percent propylene units. The compression toughness was measured on the pure A3100 materials using aforementioned compression test procedures. The toughness of A3100 was calculated as 105 lb-in/in$^3$.

The toner product was extruded using a Werner & Pfleiderer ZSK-28 twin screw extruder at barrel set temperatures ranging from 90° C. to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified, and toner particles with volume average diameter of about 4 to 9 microns were measured by a Coulter Counter. Jetting rates were calculated from collection yields, and found to be 23 pounds/hour.

This toner was analyzed using a centrifugal, density separation technique for the percent by weight of the free wax particles and determined to be less than our detection limit of 0.1 percent by weight for all toners prepared. The percent of total wax was estimated by differential scanning calorimetry and found to equal the 4 percent preprocess concentration. Wax domain size was estimated, from TEM photo analysis, to be on average less than 0.9 micron in diameter with a standard deviation of 0.4 micron. Wax diameters from comparative toners without compatibilizer have a mean value of 6.4 microns with a standard deviation of 2.4 microns.

Subsequently, there was prepared a developer composition by admixing the aforementioned formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent, thereover of a polyvinylidine fluoride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. The copy quality was judged excellent, as per the methods used in Example I with complete, uniform solid area and lines, and no measured background throughout the aforementioned imaging test. Fusing conditions for the imaging device were varied so as to determine the minimum fix temperature behavior from the developed image. The paper was released easily after the toner image was fused and no scratching was caused by stripper fingers present in the imaging device on developed solid areas as determined by visual examination. The Hot Offset Temperature (HOT) evaluated as the temperature that the toner image starts to offset onto the fuser roll. Fusing evaluation by a standard image crease test was performed, and the minimum fix temperature of the toner was found to be F=−33° C. compared to an F=−19° C. to −20° C. for the same toner without the above compatibilizer. A more negative value of "F" represents a lower fusing temperature.

EXAMPLE III

A toner was prepared by repeating the toner melt mixing procedure of Example I with the exception that a styrene-olefins copolymer containing about 50 percent styrene and being prepared by the following process was selected as the compatibilizer at 4 percent by weight of premix concentration.

Functional polystyrenes, such as polystyrene end-capped with one acidic group, were obtained from Polymer Chemistry Innovations, Inc., of PA. The percentage of the acidic functionality is 85 percent by mole. Functional polyolefins, such as glycidyl methacrylate modified ethylene copolymers, OREVAC® 9312Y, were obtained from Elf Atochem North America, Inc., of Philadelphia, Pa. The percentage of glycidyl methacrylate in OREVAC® 9312Y was reported as 5.5 percent by weight. The low toughness compatibilizers can then be obtained by a reactive process of the aforementioned functional polystyrenes with the functional polyolefins, wherein there is premixed at 50/50 by weight, and were melt mixed using a Haake batch mixer at 150 rpm at 220° C. for 15 minutes. The glycidyl group of polystyrene reacted with the acidic group on polyolefins to form a graft copolymer (based on $H^1$NMR). The effectiveness of the compatibilizer in its stabilization of the wax dispersion, especially during melt extrusion processing of toner, was found to be related to both the polystyrene content and segment molecular weight. The compression toughness was measured on the graft copolymer materials using aforementioned compression test procedures. The toughness was calculated as 155 lb-in/in$^3$.

The toner product was extruded using a Werner & Pfleiderer ZSK-28 twin screw extruder at barrel set temperatures ranging from 90° C. to 120° C. at a throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified, and toner particles with volume average diameter of about 4 to about 9 microns were measured by a Coulter Counter. Jetting rates were calculated from collection yields, and found to be 22 pounds/hour.

This toner was analyzed using a centrifugal, density separation technique for the percent by weight of the free wax particles, and determined to be less than our detection limit of 0.1 percent by weight for all toners prepared. The percent of total wax was estimated by differential scanning calorimetry and found to equal the 4 percent preprocess concentration. Wax domain size was estimated, from TEM photo analysis, to be on average less than 0.8 micron in diameter with a standard deviation of 0.4 micron. Wax diameters from comparative toners without compatibilizer have a mean value of 6.4 microns with a standard deviation of 2.0 microns.

Subsequently, there was prepared a developer composition by admixing the aforementioned formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent, thereover of a polyvinylidine fluoride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. The copy quality was judged excellent, as per the methods used in Example I with complete, uniform solid area and lines, and no measured background throughout the aforementioned imaging test. Fusing conditions for the imaging device were varied so as to determine the minimum fix temperature behavior from the developed image. The paper was released easily after the toner image was fused and no scratching was caused by stripper fingers present in the imaging device on developed solid areas as determined by visual examination. Fusing evaluation by a standard image crease test was performed, and the minimum fix temperature found to be F=−32° C. compared to an F=−19° C. for toner without this compatibilizer, and wherein a more negative value of "F" represents a lower fusing temperature.

COMPARATIVE EXAMPLE IV

Two toners were prepared by repeating the procedure of Example I with the exception that a commercial block copolymer (Shell KRATON G1726X®) was selected at 2 percent by weight and at 4 percent by weight as compatibilizer for a 4 percent VISCOL 660P™ wax formulation, instead of the pure, styrene-isoprene diblock copolymer. This compatibilizer, which was disclosed in U.S. Pat. No. 5,229,242, was comprised of 70 percent diblock and 30 percent styrene-ethylene/butylene-styrene triblock as per the coupling of diblock chains during its manufacture. The compression toughness was measured using the aforementioned compression test procedures. The toughness was calculated as 545 lb-in/in$^3$. The above toughness of 545 compared to the toughness of the compatibilizer of the present invention translates into a lower jetting rate and undesirable fusing compared to previous Examples I to III.

The toner product was extruded using a Werner & Pfleiderer ZSK-28 twin screw extruder at barrel set temperatures ranging from 90° C. to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified, and toner particles with volume average diameter of about 4 to about 9 microns were measured by a Coulter Counter.

A toner jetting rate of 13 pounds/hour was observed for the 2 percent compatibilizer toner and a rate estimated to be less than 11 pounds/hour for the 4 percent toner. Wax domain size was estimated, per TEM procedures used in Example I, to average 4 microns (microns in average volume diameter) with a standard deviation of 2.4 microns. The jetting rate in Examples I and II are 1.7 to 2.2 times higher than that in the Comparative Example. The average wax domain size in Examples I and II was about 30 percent smaller than that in the Comparative Example IV.

Subsequently, there was prepared a developer composition by admixing the aforementioned formulated toner composition mechanically blended at 73° F. at a 3.0 percent toner concentration. The prepared developer composition was then incorporated into the same electrostatographic imaging device of Example I, and a test run of 1,000 copies was accomplished. The copy quality for the developed images was excellent throughout the test. The paper was released easily after fusing. Fusing evaluation was performed by a standard crease test method. Minimum fusing temperature was found to have an F=−23° C. to −24° C. or 8° C. to 12° C. higher than that of the toners in Example I, II and III.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of resin, colorant, wax, and a compatibilizer of the formula $$A_{(a)}—B_{(b)}—C_{(c)}—D_{(d)}—$$

wherein A is ethylene, B is propylene, C is butene, and D is pentene, and wherein the mol fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1.

2. A toner in accordance with claim 1 wherein the colorant is a pigment.

3. A toner in accordance with claim 1 wherein each of a, b, c, and d are from about 0.1 to about 0.8.

4. A toner in accordance with claim 1 wherein the weight average molecular weight, $M_w$, of said compatibilizer is from about 1,000 to about 50,000.

5. A toner in accordance with claim 1 wherein the weight average molecular weight, $M_w$, of said compatibilizer is from about 1,500 to about 20,000.

6. A toner in accordance with claim 1 wherein the compatibilizer further contains E, F, and G, and which compatibilizer is of the formula $$A_{(a)}—B_{(b)}—C_{(c)}—D_{(d)}—E_{(e)}—F_{(f)}—G_{(g)}$$

and wherein E is a reactive functional group, F is a reactive functional group and G is styrene, and each e, f, and g are mol fractions of from about 0.05 to about 0.95, and wherein the sum of a, b, c, d, e, f, and g is about 1 mol fraction.

7. A toner in accordance with claim 6 wherein E is a reactive functional group of an acid, an anhydride, a hydroxyl, a glycidyl, or an amine; and F, which is reactive with E at elevated temperatures, is an anhydride, a hydroxyl, an acid, a glycidyl, or an amine group.

8. A toner in accordance with claim 7 wherein the reaction of E and F is an acid-glycidyl reaction, an amine-glycidyl reaction, an anhydride-glycidyl reaction, an anhydride-amine reaction, a hydroxyl-acid reaction, or a hydroxyl-glycidyl reaction.

9. A toner in accordance with claim 6 wherein the $M_w$ of said E, F, and G segments is from about 1,000 to about 50,000, or from about 1,500 to about 20,000.

10. A toner in accordance with claim 6 wherein said E, and F segments are present in the polymer in an amount of from about 0.05 to 10 per polymer chain.

11. A toner in accordance with claim 1 wherein the compatibilizer is an elastomeric thermoplastic styrene copolymer.

12. A toner in accordance with claim 1 further containing second crosslinked resin particles.

13. A toner composition in accordance with claim 1 wherein the compatibilizer possesses a compression toughness of less than about 400 lb-in/in$^3$.

14. A toner composition in accordance with claim 1 wherein the wax and the compatibilizer together form domains of an average particle diameter of from about 0.1 to about 2 microns.

15. A toner composition in accordance with claim 1 wherein the compatibilizer is present in an amount of from about 0.5 to about 10 weight percent.

16. A toner composition in accordance with claim 2 wherein the compatibilizer is present in an amount of from about 1 to about 3 percent.

17. A toner composition in accordance with claim 1 wherein the resin particles are selected from the group consisting of polyesters, styrene butadiene copolymers, styrene diene copolymers, styrene polyolefin copolymers, styrene acrylate copolymers, and styrene methacrylate copolymers.

18. A toner composition in accordance with claim 17 wherein the polyester results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol.

19. A toner composition in accordance with claim 12 wherein the first resin particles are present in an amount of from about 40 to about 90 weight percent, and the second resin particles are present in an amount of from about 60 to about 10 weight percent.

20. A toner composition in accordance with claim 12 wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent.

21. A toner composition in accordance with claim 1 wherein the colorant is the pigment carbon black, magnetite, magenta, cyan, yellow, or mixtures thereof.

22. A toner composition in accordance with claim 1 wherein the wax has a weight average molecular weight of from about 1,000 to about 10,000, wherein the wax is a polyolefin, or mixture of polyolefins, and wherein said wax is present in an amount of from about 1 to about 10 weight percent, and which toner further contains a charge enhancing additive selected from the group consisting of distearyl dimethyl ammonium methyl sulfate, a cetyl pyridinium halide, and stearyl phenethyl dimethyl ammonium tosylate, and wherein the polyolefin is polyethylene or polypropylene.

23. A developer composition comprised of the toner composition of claim 1, and carrier particles.

24. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

25. A process for minimizing the amount of wax that escapes from a toner which comprises melt mixing toner resin, colorant, a wax component, and the compatibilizer of claim 1.

26. A toner in accordance with claim 1 wherein said wax possesses a molecular weight of from about 1,000 to about 20,000.

27. A toner in accordance with claim 1 wherein said wax possesses a molecular weight of from about 1,000 to about 7,000.

28. A toner in accordance with claim 1 wherein the wax is polyethylene or polypropylene, and which wax is optionally present in an amount of from about 0.5 to about 10 weight percent.

29. A toner in accordance with claim 1 wherein said resin particles are comprised of a polyester.

30. A toner in accordance with claim 1 wherein said colorant is a magnetite.

31. A toner comprised of first resin and second resin, colorant, wax, and a compatibilizer of the formula $$A_{(a)}—B_{(b)}—C_{(c)}—D_{(d)}—$$

wherein A is ethylene, B is propylene, C is butene, and D is pentene, and wherein the mol fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1.

32. A toner in accordance with claim 31 wherein the compatibilizer further contains E, F, and G, and which compatibilizer is of the formula $$A_{(a)}—B_{(b)}—C_{(c)}—D_{(d)}—E_{(e)}—F_{(f)}—G_{(g)}$$

and wherein E is a reactive functional group, F is a reactive functional group and G is styrene, and e, f, and g are mol fractions of from about 0.05 to about 0.95, and wherein the sum of a, b, c, d, e, f, and g is about 1 mol fraction.

33. A toner in accordance with claim 31 wherein said second resin is a crosslinked resin.

34. A process for minimizing the amount of wax that escapes from a toner which comprises melt mixing toner resin, colorant, a wax component, and the compatibilizer of claim 6.

* * * * *